US011456135B2

(12) United States Patent
Kubono

(10) Patent No.: US 11,456,135 B2
(45) Date of Patent: Sep. 27, 2022

(54) RELAY

(71) Applicant: FUJITSU COMPONENT LIMITED, Tokyo (JP)

(72) Inventor: Kazuo Kubono, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 49 days.

(21) Appl. No.: 16/682,159

(22) Filed: Nov. 13, 2019

(65) Prior Publication Data

US 2020/0176207 A1 Jun. 4, 2020

(30) Foreign Application Priority Data

Nov. 30, 2018 (JP) ..... JP2018-225896

(51) Int. Cl.
*H01H 50/24* (2006.01)
*H01H 50/14* (2006.01)
*H01H 50/54* (2006.01)

(52) U.S. Cl.
CPC ..... *H01H 50/24* (2013.01); *H01H 50/14* (2013.01); *H01H 50/54* (2013.01)

(58) Field of Classification Search
CPC ..... H01H 50/24; H01H 50/54; H01H 50/26
USPC ..... 335/187, 129, 78, 128
See application file for complete search history.

(56) References Cited

U.S. PATENT DOCUMENTS 2,900,472 A * 8/1959 Dowdle ..... H01H 50/66 335/187
3,395,259 A * 7/1968 Brick ..... H01H 50/26 218/27
3,684,986 A * 8/1972 Nagamoto ..... H01H 50/648 335/200
4,339,734 A * 7/1982 Minks ..... H01H 51/2236 335/78
5,191,306 A * 3/1993 Kaji ..... H01F 7/14 335/78
5,844,456 A * 12/1998 Mader ..... H01H 50/24 335/85
6,265,958 B1 * 7/2001 Yoshino ..... H01H 50/28 335/274
6,633,214 B2 * 10/2003 Mochizuki ..... H01H 50/026 335/78

(Continued)

FOREIGN PATENT DOCUMENTS

EP 3089190 A1 11/2016
JP 3959894 B2 8/2007

(Continued)

*Primary Examiner* — Alexander Talpalatski

(74) *Attorney, Agent, or Firm* — Shumaker & Sieffert, P.A.

(57) ABSTRACT

Examples of a relay are described, with which the characteristics of the relay such as the operating voltage can be prevented from changing, even when impact is applied to the relay. The relay has an electromagnet, an armature which pivots about a pivot axis by excitation of the electromagnet, a pressing member attached to a tip of the armature, and a terminal which is pressed by the pressing member, wherein the armature comprises a plate-like insertion part which extends in a direction parallel to the pivot axis, and a guide groove provided in the insertion part and which extends in a direction parallel to the pivot axis, and the pressing member comprises an enclosure which is open on one end, and a part of the enclosure is inserted into the guide groove.

8 Claims, 18 Drawing Sheets

(56) References Cited

U.S. PATENT DOCUMENTS

| | | | | |
|---|---|---|---|---|
| 7,106,154 | B2 * | 9/2006 | Takano | H01H 50/043 335/128 |
| 8,207,803 | B2 * | 6/2012 | Iwamoto | H01H 50/026 335/78 |
| 8,928,438 | B2 * | 1/2015 | Masui | H01H 50/642 335/274 |
| 9,064,665 | B2 * | 6/2015 | Li | H01H 50/642 |
| 2004/0113729 | A1 * | 6/2004 | Sanada | H01H 50/642 335/129 |
| 2008/0048808 | A1 | 2/2008 | Kozai et al. | |
| 2012/0081199 | A1 * | 4/2012 | Hao | H01H 51/08 335/158 |
| 2014/0022035 | A1 * | 1/2014 | Yamashita | H01H 9/443 335/201 |
| 2020/0176206 | A1 * | 6/2020 | Kubono | H01R 13/2442 |
| 2020/0176209 | A1 * | 6/2020 | Kubono | H01H 50/14 |

FOREIGN PATENT DOCUMENTS

| | | | |
|---|---|---|---|
| JP | 2008-053152 | A | 3/2008 |
| JP | 5741679 | B1 | 7/2015 |

* cited by examiner

RELAY

This application is based upon and claims the benefit of priority of the prior Japanese Patent Application No. 2018-225896, filed Nov. 30, 2018, the entire contents of which are incorporated herein by reference.

TECHNICAL FIELD

The present invention relates to an electronic relay.

BACKGROUND

Relays (electromagnetic relays), in which contacts are opened and closed by an electromagnet, comprise an electromagnet, an armature, a movable terminal including a movable contact, and a fixed terminal including a fixed contact. In such relays, the armature is moved by the excitation of the electromagnet, whereby the armature is pressed against the movable terminal, and contact between the movable contact and the fixed contact come is established.

JP 5741679 B 1 discloses a relay comprising a terminal in which a first member including a movable contact and a second member including a leg are affixed thereto by crimping in three locations.

JP 3959894 B discloses a relay in which an insulated pressing member, which presses a movable terminal, is attached to an armature to secure the insulation distance between the movable terminal and the armature.

JP 2008-053152 A discloses a relay in which an electromagnet and an armature are surrounded with an insulating wall, so as to secure the insulation distance for a movable terminal and a fixed terminal.

SUMMARY

In some cases of an electronic relay, the pressing member attached to the tip of the armature may become misaligned with respect to the armature due to impact, etc. When the pressing member becomes misaligned with respect to the armature, there is a risk that the characteristics of the relay, such as the operating voltage necessary for bringing the movable contact and the fixed contact into contact with each other, may change.

An aspect of the present invention provides a relay, comprising: an electromagnet, an armature which pivots about a pivot axis by excitation of the electromagnet, a pressing member attached to a tip of the armature, and a terminal which is pressed by the pressing member, wherein the armature comprises a plate-like insertion part which extends in a direction parallel to the pivot axis, and a guide groove provided in the insertion part and which extends in a direction parallel to the pivot axis, and the pressing member comprises an enclosure which is open on one end, and a part of the enclosure is inserted into the guide groove.

According various aspects, when the pressing member is attached to the armature, since the insertion part of the armature is inserted into the pressing member while a state in which a part of the enclosure of the pressing member is inserted into the guide groove of the armature is maintained, the direction in which the positional relationship between the armature and the pressing member changes becomes the direction along the guide groove, i.e., the direction parallel to the pivot axis of the armature. Thus, even if the positional relationship between the armature and the pressing member changes due to impact or the like, the distance from the pivot axis of the armature to the contact between the pressing member and the terminal does not change, whereby changes in characteristics such as operating voltage can be prevented.

DETAILED DESCRIPTION

Figure 1:
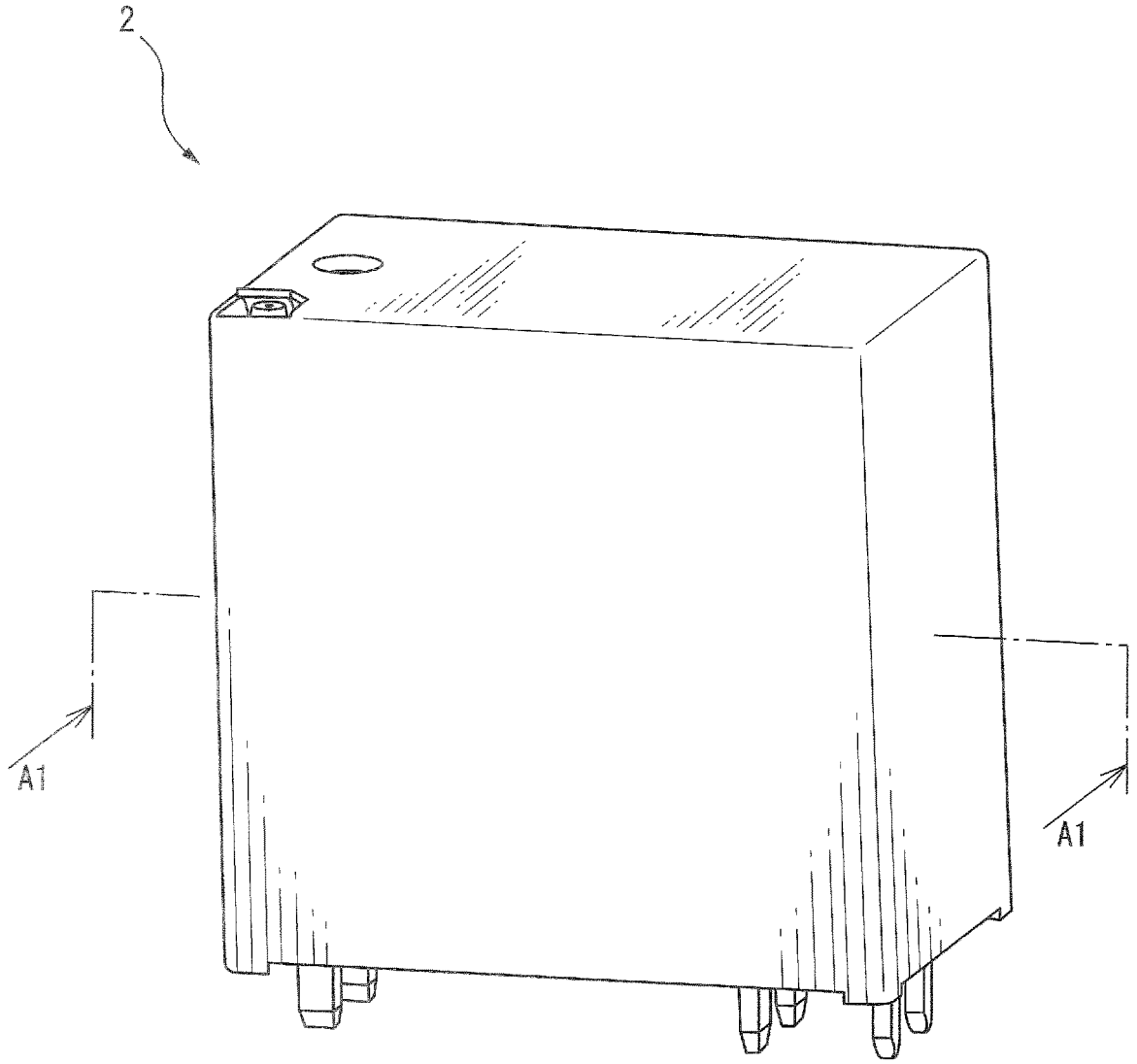
FIG. 1 is a perspective view of a relay according to an embodiment.
Figure 2:
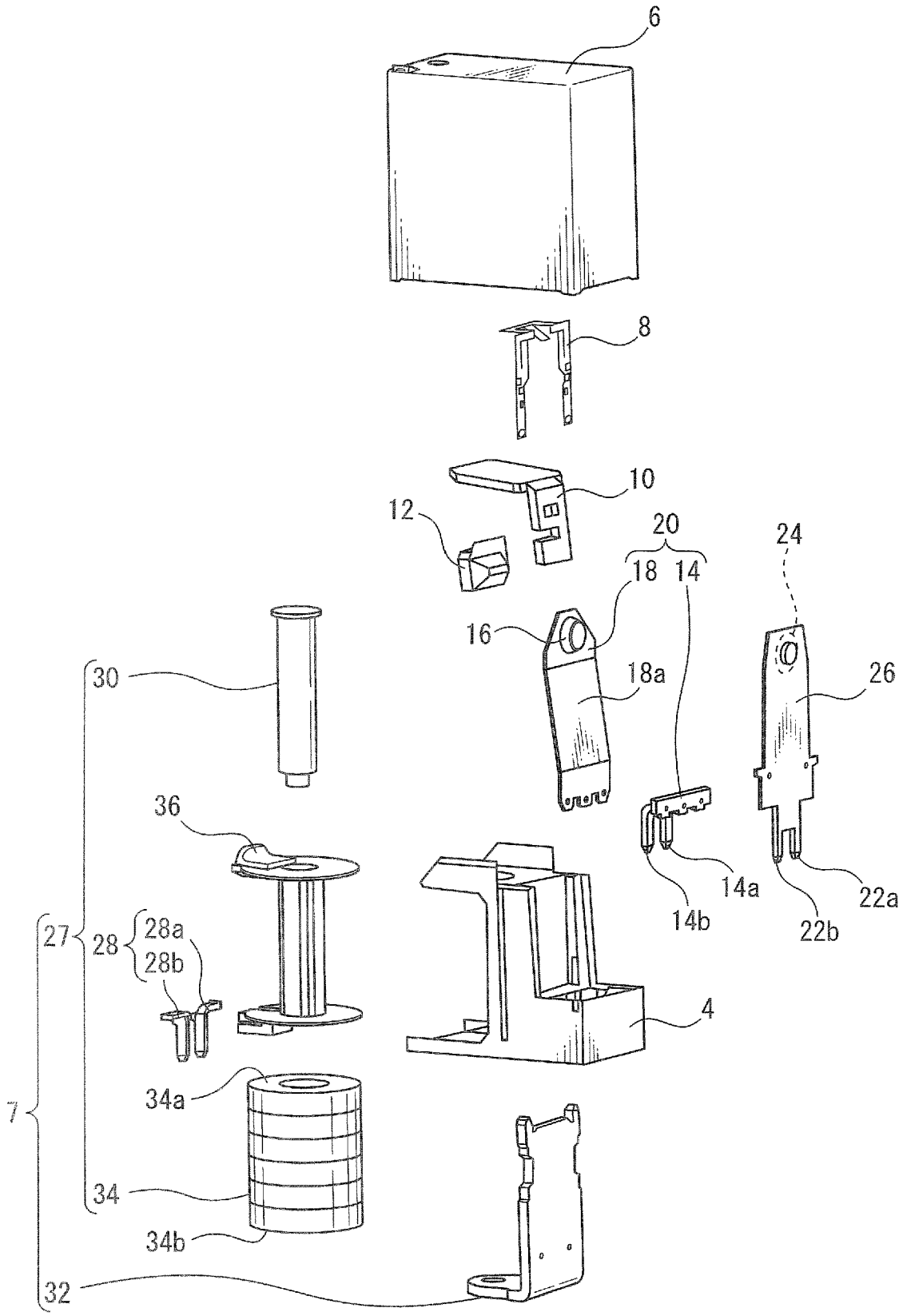
FIG. 2 is an exploded perspective view of the relay.

The relays according to the embodiments will be described below with reference to the attached drawings. FIG. 1 is a perspective view of a relay 2 according to an embodiment, and FIG. 2 is an exploded perspective view. The relay 2 comprises a base 4 in which the constituent parts are assembled, and a cover 6 which encloses the base 4. The base 4 and the cover 6 may be, for example, molded parts made of resin.

The constituent parts assembled in the base 4 include a movable terminal 20, a fixed terminal 26, an electromagnet 7, a hinge spring 8, an armature 10, and a pressing member 12 made of a resin or the like.

The movable terminal 20 comprises a first member 14 including two legs 14*a*, 14*b*, and a second member 18 including a movable contact 16. The fixed terminal 26 comprises two legs 22*a*, 22*b*, and a fixed contact 24. The electromagnet 7 comprises a coil assembly 27, an iron core 30, and a yoke 32. The coil assembly 27 comprises two coil terminals 28 comprising respective legs 28*a*, 28*b*, a coil 34 which is connected to the coil terminals 28, and a bobbin 36 on which the coil 34 is wound.

The electromagnet 7 is excited by applying a voltage to the terminals 28. Due to the excitation of the electromagnet 7, the armature 10 pivots and contacts the iron core 30. The pressing part 12 attached to the armature 10, and presses the movable terminal 20 in accordance with the pivoting of the armature 10, and the movable contact 16 comes in contact with the fixed contact 24. The hinge spring 8 is attached to the armature 10 and the yoke 32, and biases the armature 10 in a direction away from the iron core 30.

When the application of voltage to the coil terminal 28 is stopped, the armature 10 is returns to a position spaced from the iron core 30 by the biasing of the hinge spring 8. Then, the pressing force from the pressing part 12 to the movable terminal 20 is released as the armature 10 returns, and the movable contact 16 separates from the fixed contact 24.

The movable contact 16 and the fixed contact 24 open and close with the above configuration. The aforementioned configuration is merely exemplary, and any configuration may be used. For example, the fixed terminal 26 may comprise a member including the contact 24, and a member including the legs 22*a*, 22*b*.

Figure 3:
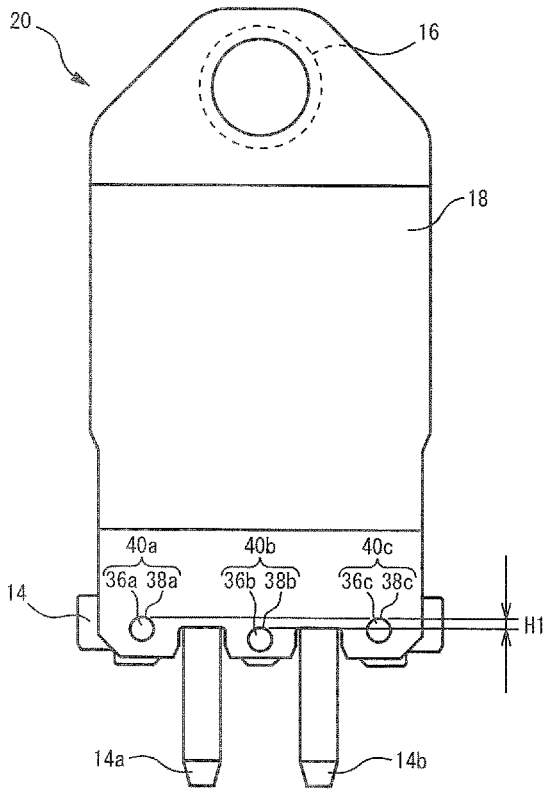
FIG. 3 is a front view of a movable terminal.

FIG. 3 is a front view of the movable terminal 20. The movable terminal 20 is constituted by an assembly of the first member 14 and the second member 18.

The first member 14 comprises legs 14*a*, 14*b*, for electrical connection with external components, and a plurality (three in the drawings) of protrusions 36*a*, 36*b*, and 36*c* (collectively "protrusions 36"). The second member 18 comprises the contact 16, and a plurality (three in the drawings) of holes 38*a*, 38*b*, and 38*c* (collectively "holes 38"). The second member 18 is a plate-like member which is elastically displaceable. The first member 14 and the second member 18 are made of, for example, a metal.

The protrusions 36 are individually inserted into the corresponding holes 38 and the tips thereof are crimped to formed crimped parts 40*a*, 40*b*, and 40*c* (collectively "crimped parts 40").

The first member 14 and the second member 18 are electrically connected and mutually affixed by the crimped parts 40. Though a voltage drop occurs when current flows through the movable terminal 20, the internal resistance of the movable terminal 20 is reduced by providing crimped parts 40, so as to reduce the voltage drop. If high current of 30 A or more flows, it is preferable that three or more crimped parts 30 be provided.

The three crimped parts 40 shown in FIG. 3 are arranged in a line. Since the protrusion 36*b* is arranged lower than the protrusions 36*a* and 36*c* by a distance H1, and the hole 38*b* is arranged lower than the holes 38*a* and 38*c* by distance H1, the center crimped part 40*b* is arranged lower than the outermost crimped parts 40*a* and 40*c* by distance H1. Distance H1 is, for example, approximately 0.3 mm.

The holes 38 may be circular, elliptical, triangular, or rectangular, and the protrusions may be shaped so as to be capable of being inserted into the respective holes.

Figure 4:
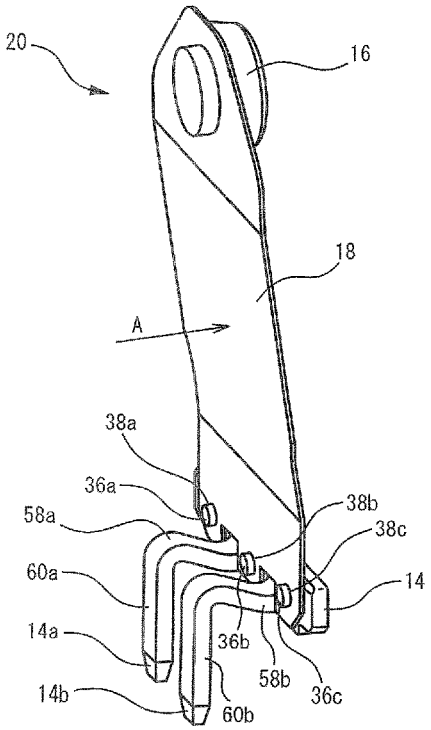
FIG. 4 is a perspective view of the movable terminal.

FIG. 4 is a perspective view of the movable terminal 20. The second member 18 is pressed in direction A by the pressing part 12, and is elastically displaced. When the second member 18 is displaced in direction A, the stress is concentrated around holes 38 in which protrusions 36 of the second member 18 are affixed.

Figure 5:
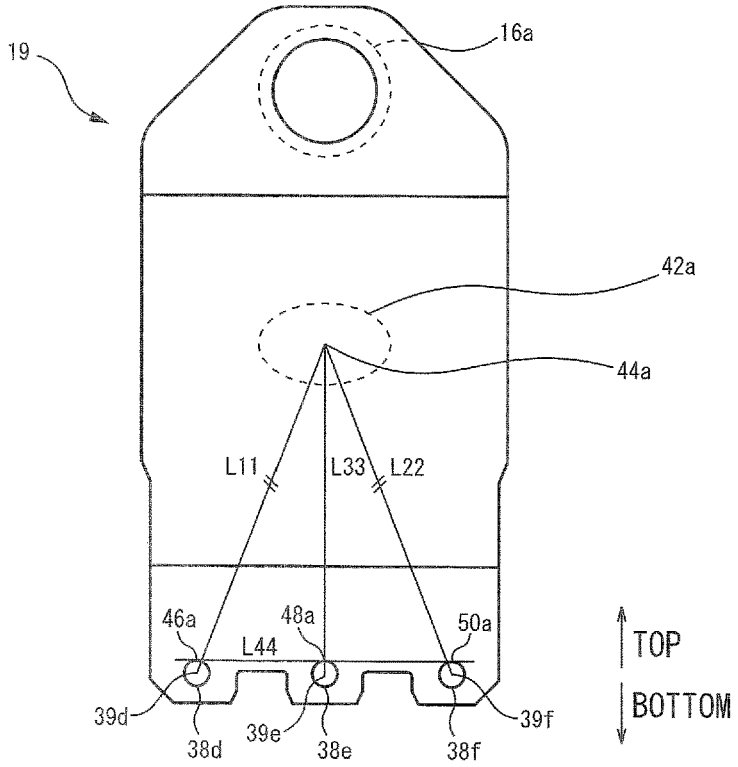
FIG. 5 is a front view of a second member having a different hole arrangement.

FIG. 5 is a front view of a second member 19 in which holes 38*d*, 38*e*, and 38*f* (collectively "holes 38") are arranged in positions different than those of FIG. 4. In the second member 19, the position of the hole 38*e* differs from that of the second member 18, and the three holes 38' are arranged at the same height.

A pressed part 42*a* is an area which is pressed by the pressing member 12. The stress in the vicinity of the holes 38' will be described using the center point 44*a* of the pressing part 42*a*. The center 44*a* is arranged in the geometrical center of the second member 19, and the force with which the pressing member 12 presses the second member 19 will be assumed as being received at a single point.

The magnitude of the stress occurring around the holes 38' due to the force applied to the center 44*a* depends on the distance from the center 44*a*. As the distance between the center 44*a* and the holes 38' decreases, the bending angle in the vicinity of the hole of the second member 19 increases and the stress increases.

In FIG. 5, a line L11 connecting the center 44*a* and the center 39*d* of the hole 38*d* and a line L22 connecting the center 44*a* and the center 39*f* of the hole 38*f* have substantially the same lengths. In this case, the stress in the vicinity of the hole 38*d* and the stress in the vicinity of the hole 38*f* due to the application of outside forces to the center 44*a* are approximately equal.

Conversely, a line L33 connecting the center 44*a* and the center 39*e* of the hole 38*e* is shorter than the lines L11 and L22. In FIG. 5, the three holes 38' are arranged in a horizontal row, and a line L44 passing along the edges 46*a*, 48*a*, 50*a* on the pressing location 42*a* side of the holes 38' is perpendicular to the line L33.

Under such a positional relationship, the stress around the hole 38*e* is greater than the stresses around the holes 38*d* and 38*f*.

Figure 6:
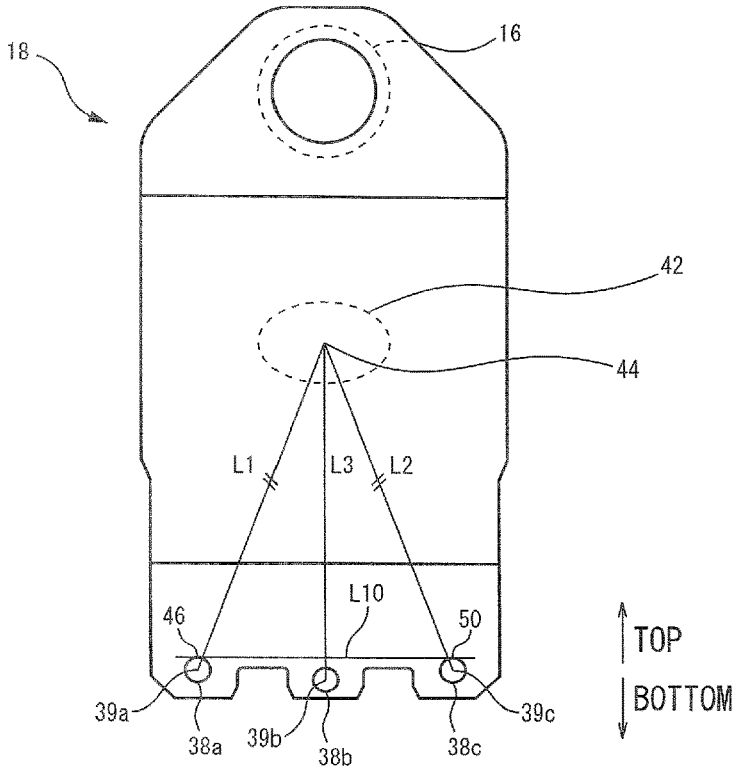
FIG. 6 is a front view of the second member.

FIG. 6 is a front view of the second member 18 according to the present embodiment. The stresses in the vicinities of the holes 38 will be described using FIG. 6.

The center hole 38*b* is arranged lower than the holes 38*a* and 38*c*. A line L10 contacts edges 46 and 50 on the contact 16 side of the holes 38*a*, 38*c*. When the holes 38*a* and 38*c* are circular, the line L10 is tangent to the circles.

The hole 38*b* is arranged on the side opposite the contact 16*b* with respect to the line L10.

A line L1 connecting the center 44 and the center 39*a* of the hole 38*a* and a line L2 connecting the center 44 and the center 39*c* of the hole 38*c* have substantially the same lengths.

The hole 38*b* is arranged lower than the holes 38*a* and 38*c*, and the hole 38*b* is arranged on the side opposite the contact 16 with respect to the line L10.

In the present embodiment, a line L3 connecting the center 44 and the center 39*b* of the hole 38*b* is longer than the line L33 of FIG. 5, and the length thereof is close to the lengths of the lines L1, L2. Thus, in the present embodiment, the stress in the vicinity of the hole 38*b* is comparatively reduced.

By arranging the hole 38*b* in a position which minimizes the difference between the lengths of the lines L1 and L2 and the length of the line L3, when a force is applied to the pressing location 42, the difference between the stress around one hole and the stresses around the other holes is minimized, and by uniformly distributing the stress, deformation of the second member 18 can be prevented.

Figure 7:
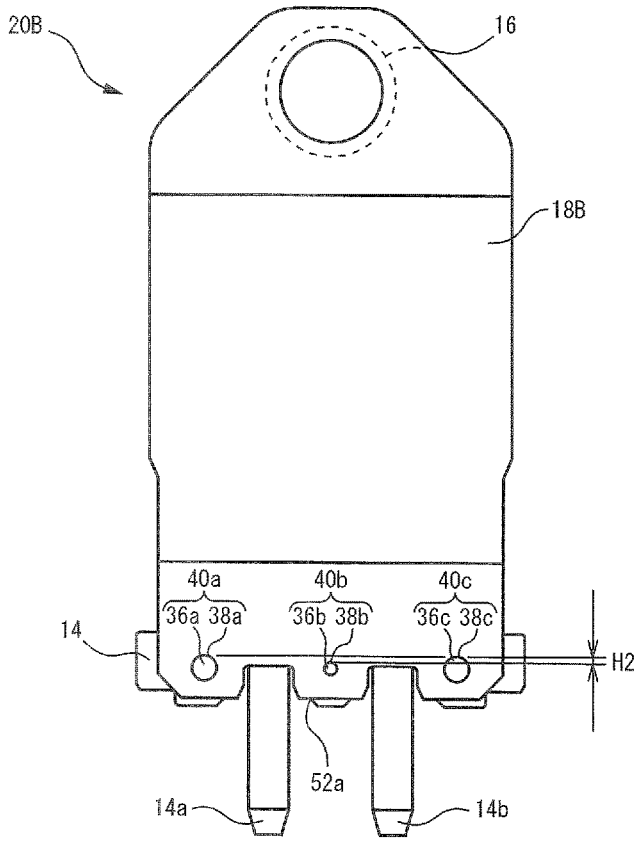
FIG. 7 is a front view of a modified example of the movable terminal.

FIG. 7 is a front view of a movable terminal 20B according to a modified example. The hole 38*b* shown in FIG. 7 is smaller than the holes 38*a* and 38*c*, and the protrusion 36*b* is smaller than the protrusions 36*a* and 36*c*. As a result, the hole 38*b* is arranged lower than the holes 38*a* and 38*c* by distance H2, and the protrusion 36*b* is arranged lower than the protrusions 36*a* and 36*c* by distance H2. Distance H2 is, for example, 0.3 mm.

Figure 8:
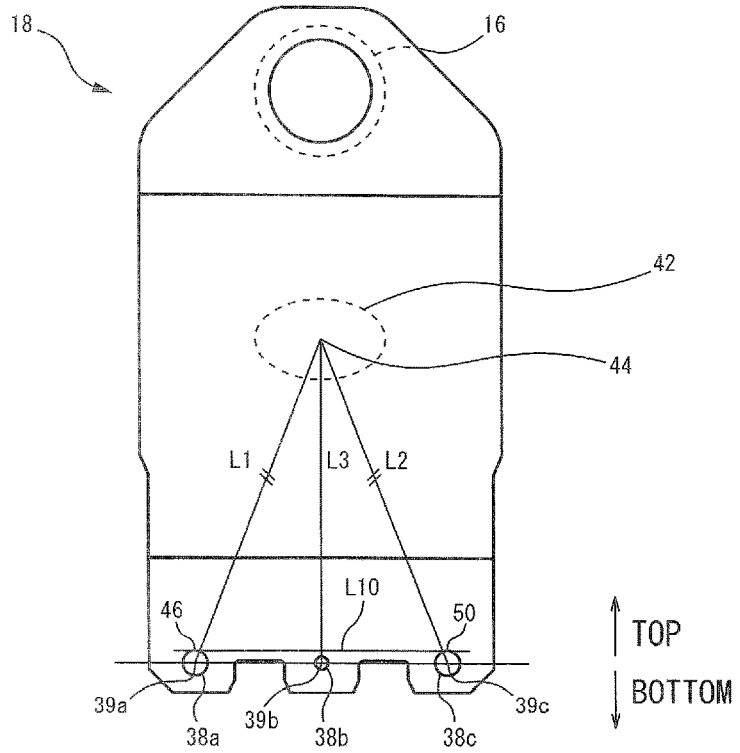
FIG. 8 is a front view of the second member according to the modified example.

FIG. 8 is a front view of a second member 18B. The stresses around the holes 38 of the second member 18B will be described using FIG. 8.

The centers 39*a*, 39*b*, and 39*c* of the holes 38*a*, 38*b*, and 38*c* are arranged on the same line, the edge of the hole 38*b* on the contact 16 side is lower than those of the holes 38*a* and 38*c*.

A line L10 contacts edges 46, 50 of the holes 38*a*, 38*c* on the contact 16 side. The hole 38*b* is arranged so as to be positioned on the side opposite the contact 16 with respect to the line L10.

A line L1 connecting the center 44 and the center 39*a* and a line L2 connecting the center 44 and the center 39*c* have substantially the same lengths.

When the hole 38*b* is arranged lower than the holes 38*a* and 38*c*, the hole 38*b* is arranged on the side opposite the contact 16 with respect to the line L10. The length of a line L3 connecting the center 44 and the center 39*b* is longer than that of the line L33 in FIG. 5, and is close to the lengths of the lines L1, L2. Thus, in the present embodiment, the stress concentrated in the vicinity of the hole 38*b* is reduced as compared to the case shown in FIG. 5.

By arranging the hole 38*b* in a position in which the difference between the lengths of the lines L1 and L2 and the length of the line L3 is minimized, when a force is applied to the pressing location 42, the difference between the stress around a single hole and the stress around the other holes is reduced, and by uniformly distributing the stress, deformation of the second member 18B can be prevented.

The movable terminal 20B is designed so as to minimize the difference between the lengths of the line L3 and the lines L1 and L2 by reducing the diameter of the hole 38*b*. Thus, since the lower end of the hole 38*b* is arranged higher as compared with the case shown in FIG. 3, the hole 38*b* can be formed without extending the edge 52*a*. Therefore, an increase in size of the movable terminal 20B can be prevented.

The crimped parts 40 can also be applied to the fixed terminal 26 comprising the first member including the contact 24 and the second member including the legs 22*a* and 22*b*.

Though the movable terminals 20 and 20B having three crimped parts 40 have been described, a terminal may have four or more crimped parts as long as the second member has at least three holes, and the edge of an intermediate hole on the contact side is arranged so as to be positioned on the side opposite the contact with respect to a line which contacts the edges of the outermost holes.

Figure 10:
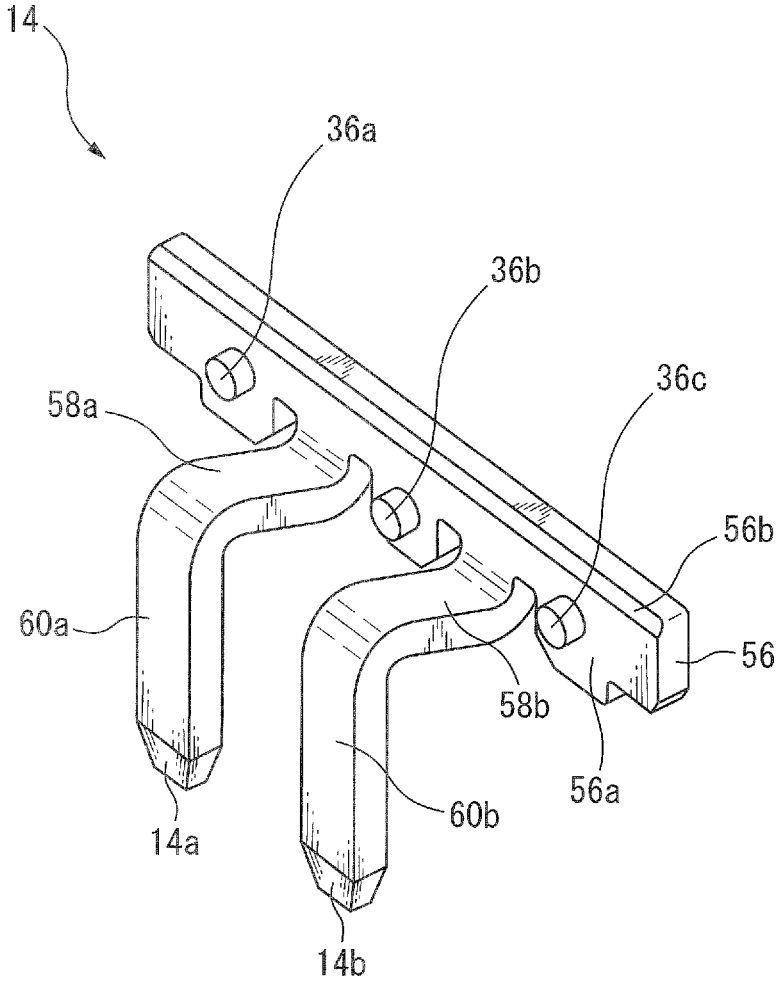
FIG. 10 is a perspective view of a first member.

FIG. 10 is a perspective view of the first member 14.

When high current is flowed through the terminal, reducing internal resistance may be reduced by increasing the sizes of the legs. When a terminal such as a blade terminal is used in order to increase the size of the legs, it is necessary to form square holes in the substrate to which the legs are connected.

Conversely, when internal resistance is reduced by providing a plurality of comparatively small legs, such as legs 14*a* and 14*b* shown in FIG. 10, comparatively small circular holes may be formed in the substrate rather than square holes, and the design of the board is easier than when a blade terminal is used.

The first member 14 comprises a support 56 having a flat surface 56*a*. Three protrusions 36 are formed on the surface 56*a*. As shown in FIG. 4, the support 56 is arranged on the second member 18 on the side on which the contact 16 is provided, and supports the second member 18.

By contacting the surface 56*a* to a surface 18*a* on which the contact 16 is provided, the surface 56*a* can absorb the force imparted to the second member 18 which is pressed by the pressing member 12.

If the first member is arranged on a side opposite the position shown in FIG. 4 to support the second member, when the second member is pressed by the pressing member, there is a risk that high stress will be generated since the stress is concentrated in the crimped part, particularly its upper end.

Conversely, in the present embodiment, the first member 14 is arranged on the side of the second member 18 that is pressed by the pressing part 12, and the lower part of the second member 18 is supported by the straight upper end 56*b* of the surface 56*a*. Therefore, the range across which the second member 18 is supported is widened. Further, as the upper end 56*b* supporting the second member 18 is separated from the crimped parts 40 by a certain distance, the stresses generated in the second member 18 in the vicinity of the crimped parts 40 can be distributed, and concentration of stress in the crimped parts 40 can be prevented. Thus, the stresses around the holes 38 when the second member 18 is pressed toward the first member 14 are reduced as compared to the case in which the support 56 is not provided.

The legs 14*a* and 14*b* will be described using FIGS. 4 and 10. The leg 14*a* comprises a base 58*a* which connects with the support 56. The base 58*a* protrudes from the side opposite the side on which the contact 16 is provided.

The leg 14*a* comprises an end 60*a* which is bent away from the base 58*a*. The end 60*a* is formed so that the bottom thereof extends in a direction away from the second member 18. The base 58*a* is bent so that the portion thereof which connects with the end 60*a* is arranged above the portion thereof which connects with the support 56. The leg 14*b* is configured in the same manner as the leg 14*a*, and comprises a base 58*b* and an end 60*b*.

Figure 11:
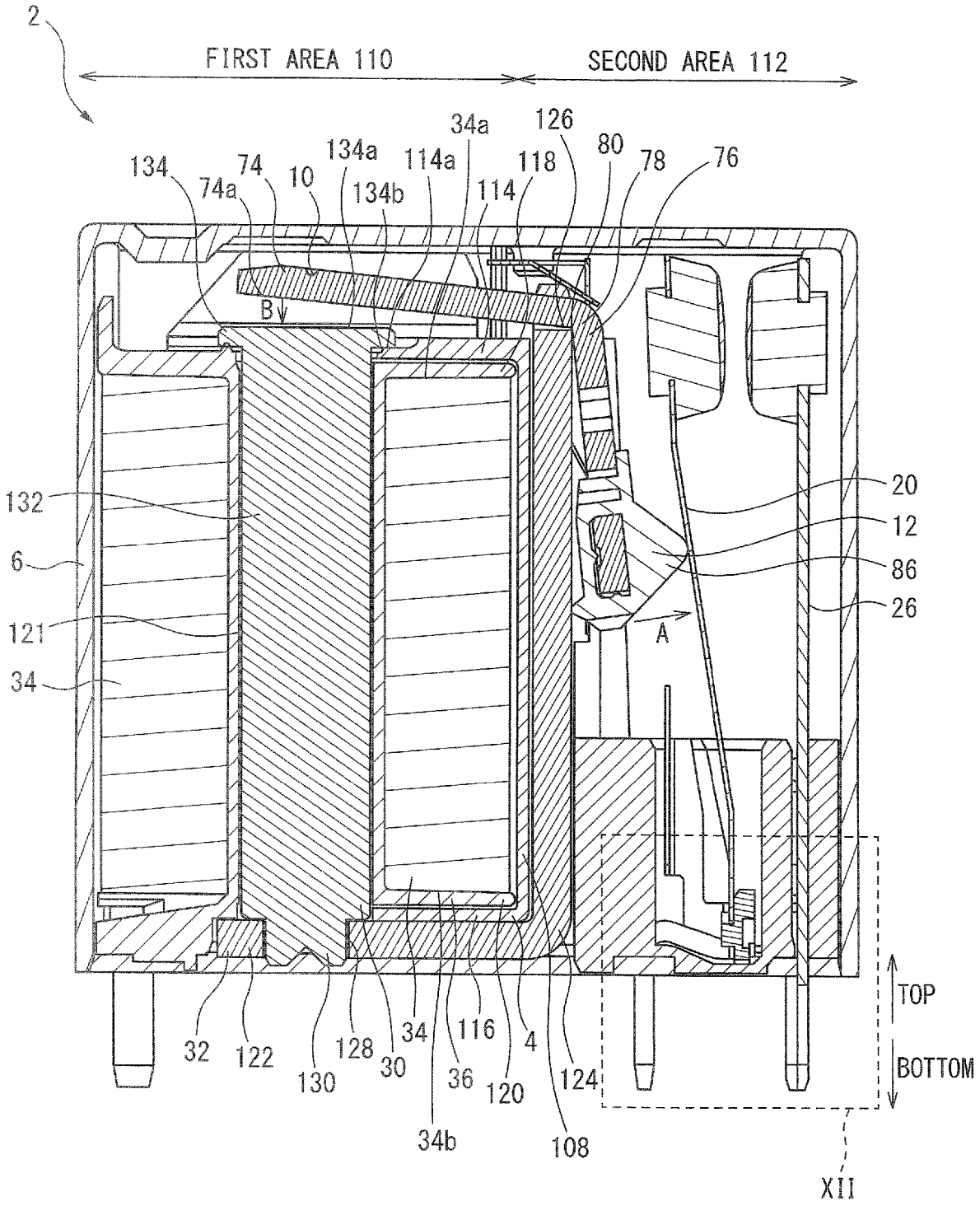
FIG. 11 is a cross-sectional view of the relay.
Figure 12:
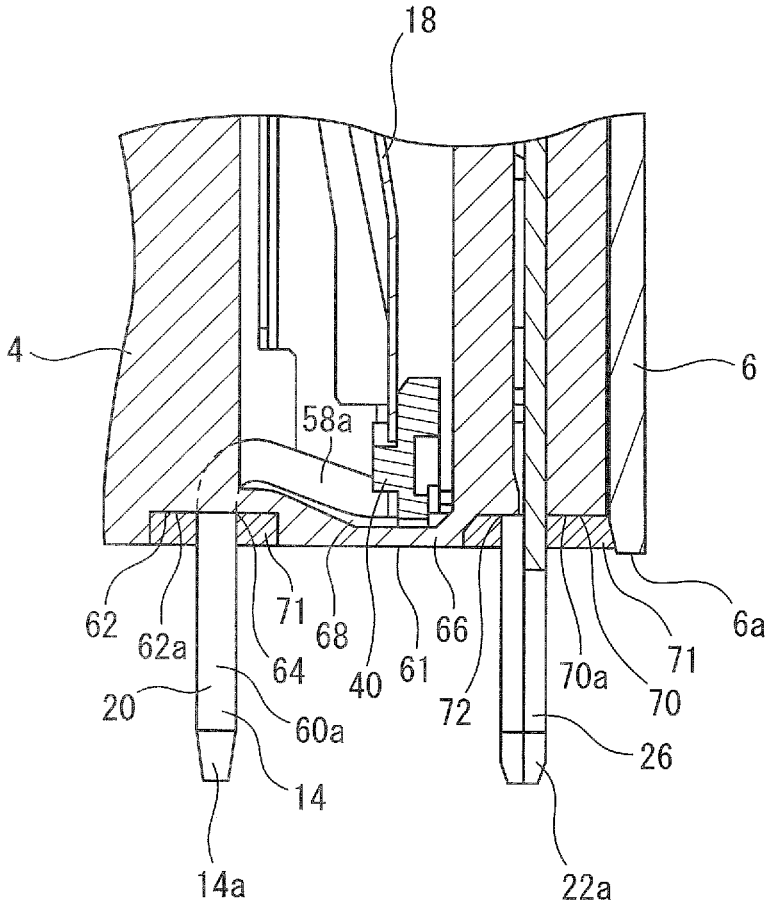
FIG. 12 is an enlarged cross-sectional view of the relay.

FIG. 11 is a cross-sectional view of the relay 2 taken along line A1-A1 of FIG. 1. FIG. 12 is an enlarged cross-sectional view of area XII of FIG. 11, which is an enlarged view of the vicinity of the first member 14. The legs 14*a* and 14*b* will be described using FIG. 12.

The base 4 houses the movable terminal 20 and the fixed terminal 26, and comprises a bottom 61 to which an adhesive 71 such as an epoxy resin is applied. The bottom 61 comprises a first adhesion part 62 having a hole 64 from which the end 60*a* of the leg 14*a* protrudes outside.

By applying the adhesive 71 to the surface 62*a* outside the first adhesion part 62 and occluding the hole 64, the intrusion of foreign matter such as solder or flux into the interior of the relay 2 can be prevented.

The bottom 61 comprises a second adhesion part 70 including a hole 72 from which the leg 22*a* protrudes outside. The adhesive 71 is applied to the surface 70*a* of the second adhesion part 70 to occlude the hole 72. The surface 62*a* and the surface 70*a* are arranged on the same plane. In order to ensure space for applying the adhesive 71, the surface 62*a* and the surface 70*a* are arranged above the lower end 6*a* of the cover 6.

The bottom 61 includes a raised part 66. The raised part 66 includes a recess 68, and bulges downward in FIG. 12, and protrudes more outwardly from the relay 2 at the position of the recess 68 than the first adhesion part 62 and the second adhesion part 70. The surface 62*a* and the surface 70*a* are arranged on the back side as viewed from below the raised part 66.

The base 58*a* is housed within the recess 68. The end 60*b* is arranged outside the recess 68, and protrudes from the hole 64. The end 60*b* does not protrude to the outside of the relay 2 from below the crimped part 40*b*. Regarding the unillustrated leg 14*b*, the base 58*b* thereof is also housed within the recess 60, and the first adhesion part 62 has an unillustrated hole from which the end 60*b* of the leg 14*b* protrudes. The adhesive 71 is applied to the hole.

By housing the bases 58*a*, 58*b* in the recess 68, and arranging the ends 60*a*, 60*b* so as to protrude to the outside of the relay 2 at positions separated from the crimped parts 40, it is not necessary to ensure space below the crimped parts 40 for applying the adhesive 71, whereby the accommodation space of the second member 18 can be expanded by the height of the recess 68. Thus, the second member 18 can be lengthened to increase the allowable current while maintaining the low profile of the relay 2.

Figure 13:
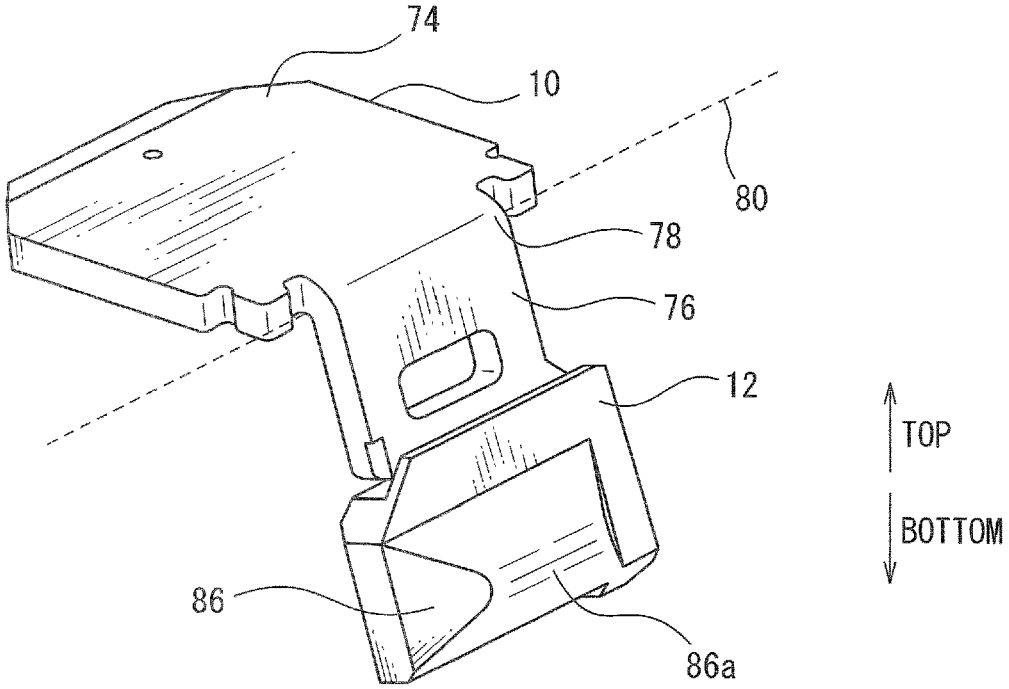
FIG. 13 is a perspective view of an armature to which a pressing member is attached.

FIG. 13 is a perspective view of the armature 10 to which the pressing member 12 is attached. The armature 10 comprises a first portion 74 which can be attracted by the iron core 30, and a second portion 76 which extends from the first portion 74. The second portion 76 comprises a bent part 78 which connects with the first portion 74. The pressing member 12 is attached to the tip of the second portion 76 and is affixed to the armature 10. The armature 10 is made of metal, and the pressing member 12 is made of resin.

The iron core 30 is arranged below the first portion 74, as shown in FIG. 11. The first portion 74 moves in direction B by the excitation of the electromagnet 7, and the surface 74*a* comes into contact with the iron core 30.

The armature 10 pivots about an axis 80, corresponds to the position of the bent part 78, while deforming the hinge spring 8. When the first portion 74 moves in direction B, the second portion 76 moves in direction A, whereby the pressing part 12 presses the movable terminal 20. The movable terminal 20 is displaced in accordance with the movement of the armature 10.

Figure 14:
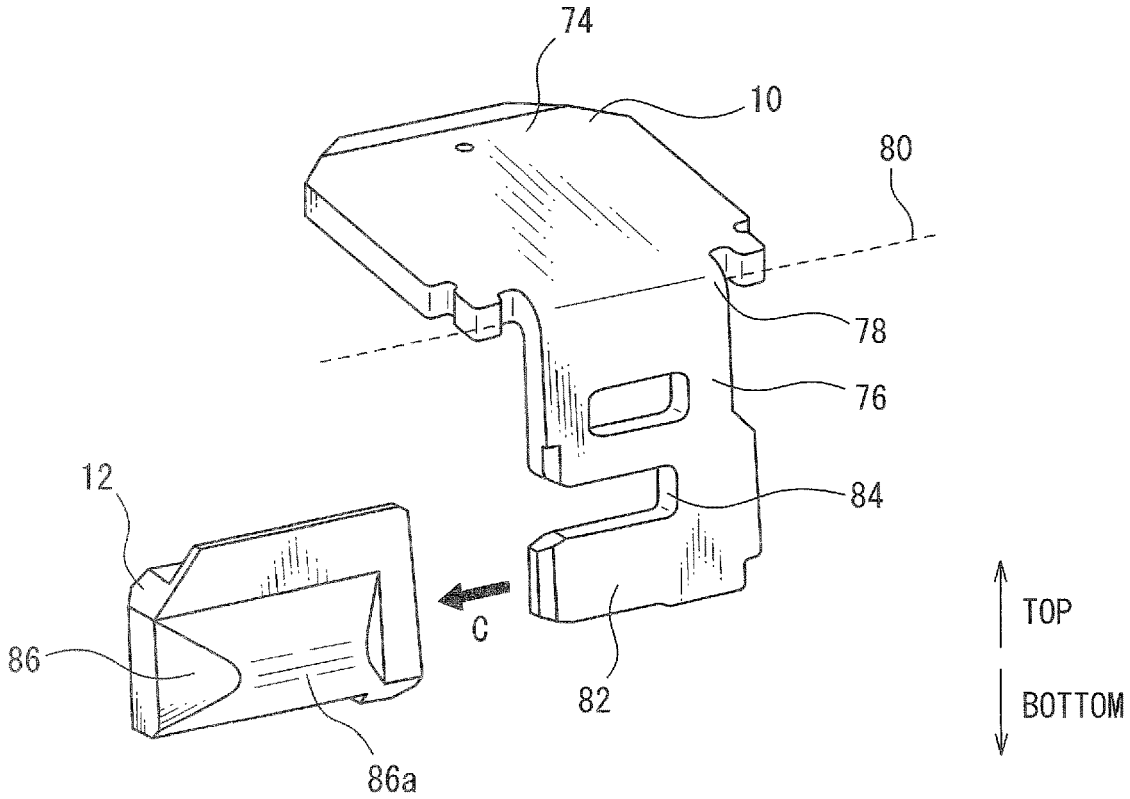
FIG. 14 is a perspective view detailing attachment of the pressing member to the armature.

FIG. 14 is a perspective view of the armature 10 and the pressing member 12. The second portion 76 includes a plate-like insertion 82 provided on the tip which is inserted into the pressing part 12, and a groove 84 formed in the upper side of the insertion 82. The insertion 82 and the groove 84 extend in the direction parallel to the axis 80, and the pressing member 12 is inserted into the groove 84. Note that the "direction parallel to the axis" encompasses substantially parallel directions in consideration of manufacturing tolerances and the like.

Figure 15:
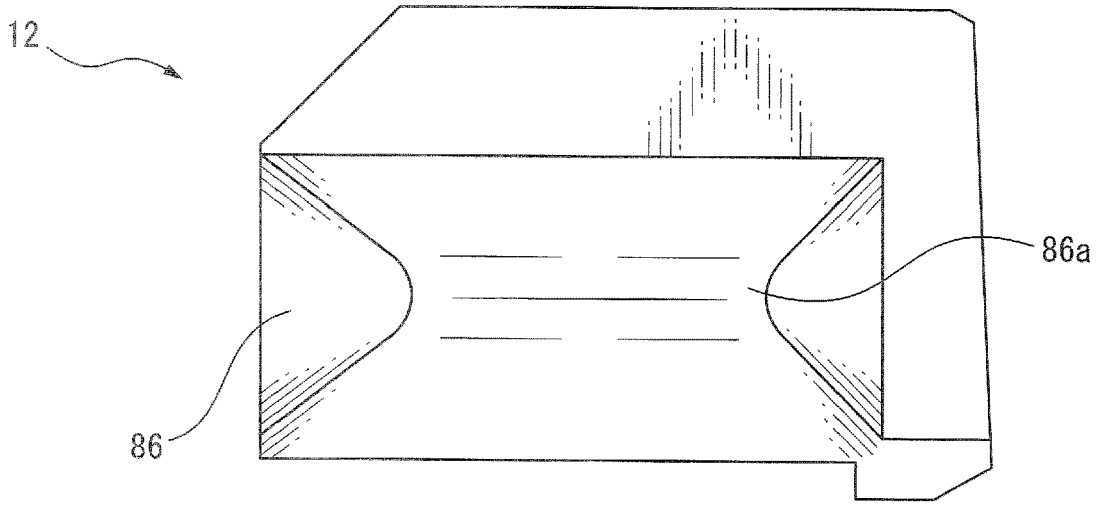
FIG. 15 is a front view of the pressing member.
Figure 16:
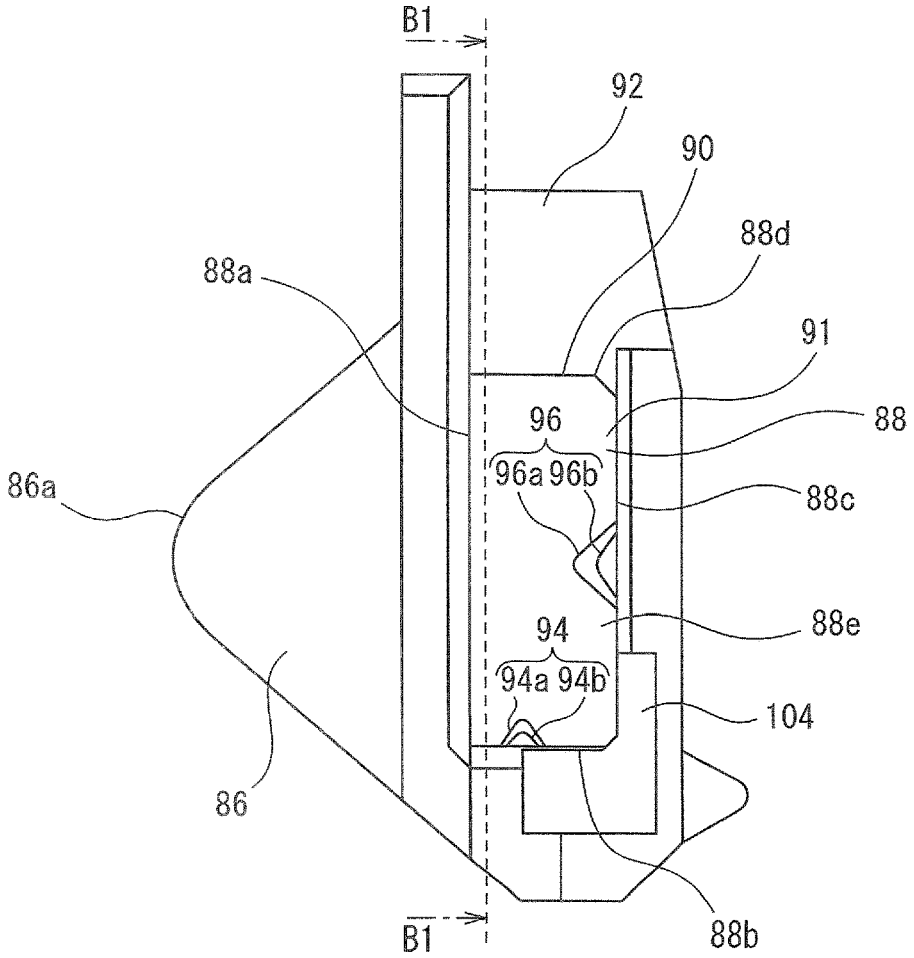
FIG. 16 is a side view of the pressing member.

FIG. 15 is a front view of the pressing member 12. FIG. 16 is a side view of the pressing member 12 as viewed from the right side of FIG. 14. The pressing member 12 comprises a pressing part 86 which protrudes toward the movable terminal 20. The tip 86*a* of the pressing part 86 extends in a straight line, and is arranged parallel to the axis 80 in a state in which the pressing member 12 is attached to the armature 10.

The pressing member 12 comprises a receiving part 88 which receives the insertion 82 in an enclosure 90 one end of which is open. The receiving part 88 has four inner surfaces 88*a*, 88*b*, 88*c*, and 88*d*, a bottom surface 88*e*, and an aperture 91 positioned on the side opposite the bottom surface 88*e*.

Figure 17:
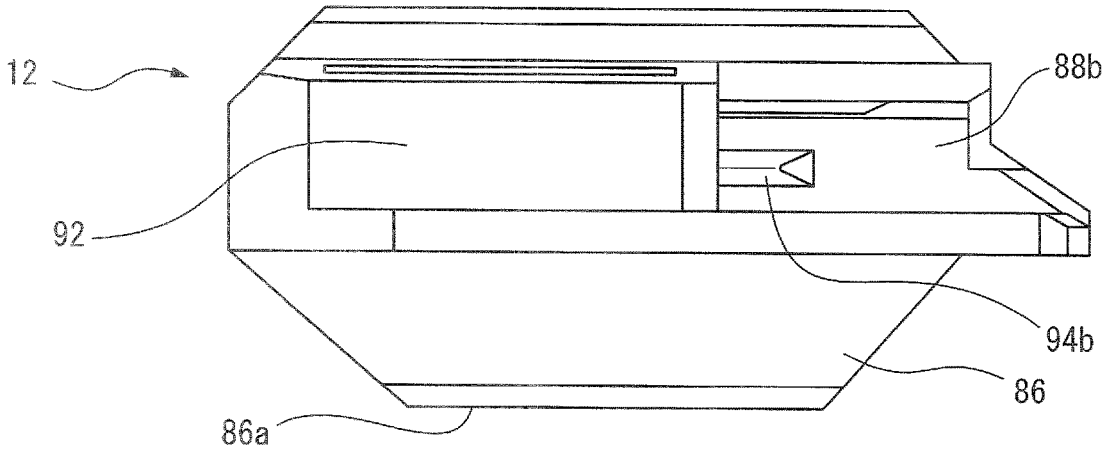
FIG. 17 is a plan view of the pressing member.

FIG. 17 is a top view of the pressing member 12. The pressing member 12 comprises an insertion 92 which is inserted into the groove 84. The insertion 92 is a part of the enclosure 90.

Figure 19:
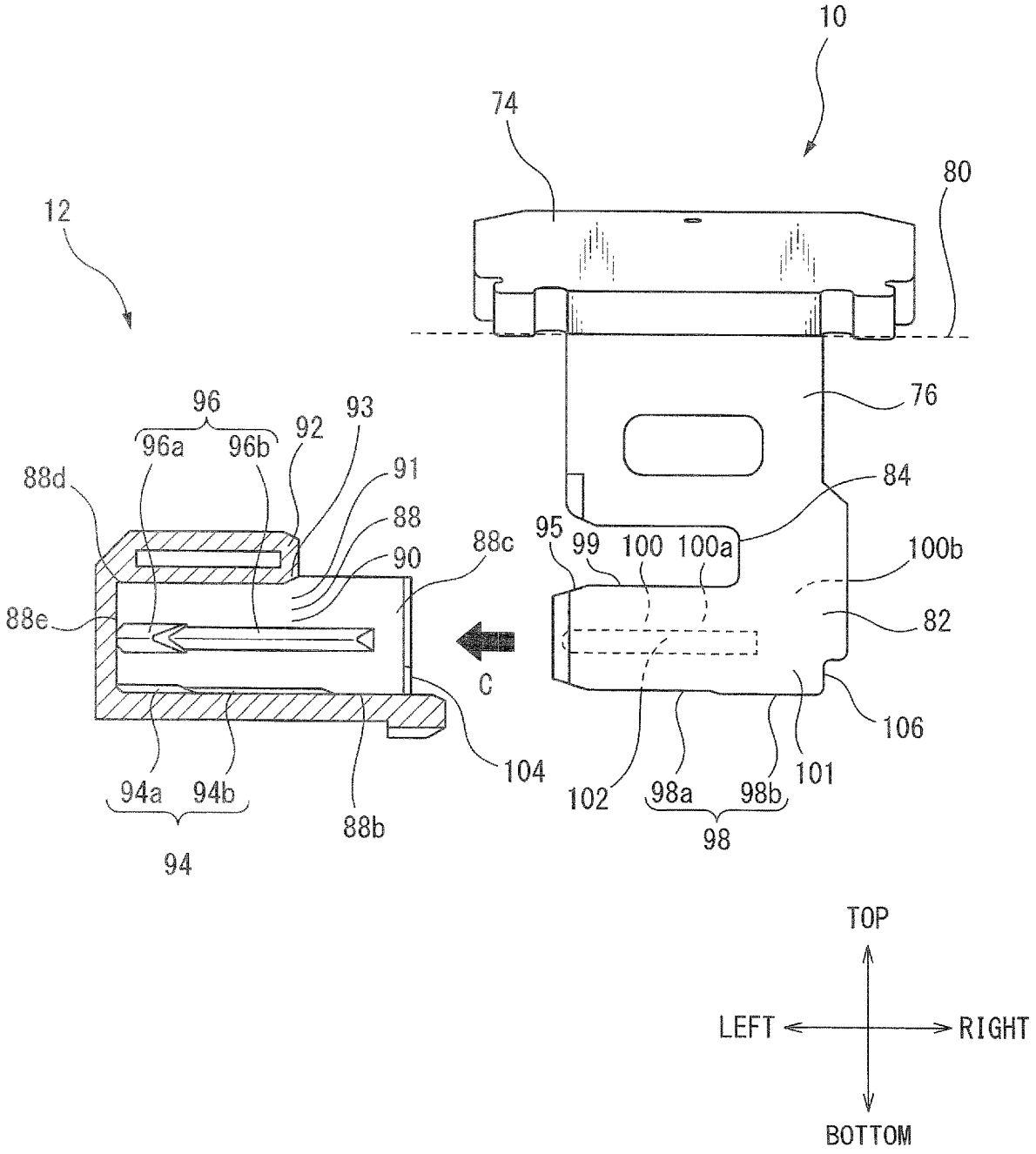
FIG. 19 is a cross-section view of the pressing member and of the armature.

FIG. 19 is a cross-sectional view of the pressing member 12 taken along line B1-B1 of FIG. 16, showing the front surface of the armature 10. The length of the inner surface 88*d* from the bottom surface 88*e* is shorter as compared to the other inner surfaces 88*a*, 88*b*, and 88*c*, and the aperture 91 is open to the right and the top of FIG. 19.

When the pressing member 12 is attached to the armature 10, the insertion 82 is inserted into the receiving part 88. By guiding the insertion 92 along the groove 84, the pressing member 12 is attached to the armature 10 along direction C, which is parallel to the axis 80.

In order to facilitate insertion of the insertion 82 into the receiving part 88, tapered guide surfaces 93, 95 are formed on the portion of the surface 88*d* close to the aperture 91, and on the tip of the insertion 82, respectively. When the insertion 82 is fully received in the receiving part 88, the receiving part 88 covers the insertion 82 with the enclosure 90.

By inserting the insertion 82 into the receiving part 88 in direction C and attaching the pressing member 12 to the armature 10 by inserting the insertion 92 into the groove 84, the pressing member is not misaligned in the vertical directions relative to the armature 10. Thus, even if misalignment of the armature 10 and the pressing member 12 occurs, the direction thereof is limited to the direction parallel to the axis 80 along the groove 84.

Figure 18:
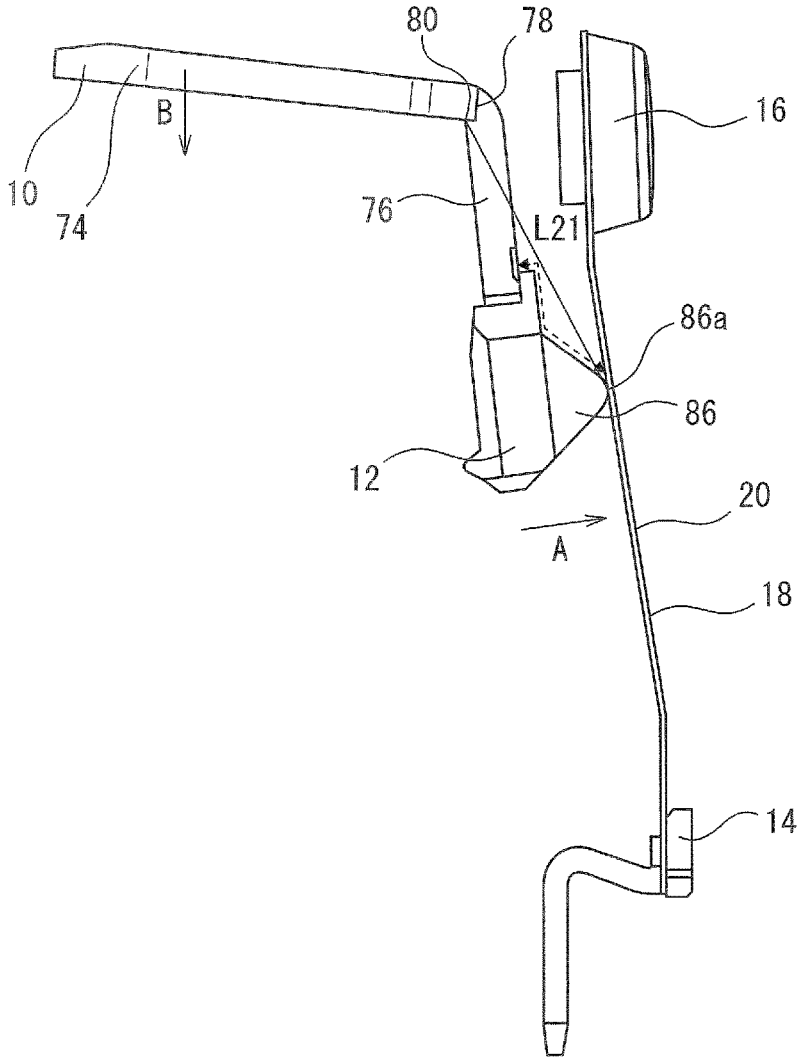
FIG. 18 is a side view showing the positional relationship between the armature, the pressing member, and the movable terminal.

FIG. 18 shows the relationship between the armature 10, the pressing member 12, and the movable terminal 20. Even if the pressing member 12 is displaced from the direction parallel to the axis 80 relative to the armature 10, a distance L21 from the axis 80 to the abutment tip 86*a* in which the pressing member 12 and the movable terminal 20 abut does not change.

Thus, in the relay 2, even if the position of the pressing member 12 is displaced relative to the armature 10 due to impact or the like, the distance L21 does not change since the direction of displacement is limited to the direction parallel to the axis 80. As long as the distance L21 does not change, the position in the vertical direction at which the pressing member 12 presses the movable terminal 20 does not change, and thus, the moment of the pressing force imparted to the movable terminal 20 from the pressing member 12 does not change. Thus, it is not necessary to change the voltage applied to the coil 34 to bring the first portion 74 of the armature 10 into contact with the iron core 30, and changes in the characteristics of the relay 2 such as operating voltage can be prevented.

The enclosure 90 covers the insertion 82 to insulate the armature 10 and the movable terminal 20 from each other. Further, a pressing part 86 protruding toward the movable terminal 20 is provided outside the enclosure 90. Therefore, the armature 10 and the movable terminal 20 are arranged in positions which are spaced from the left and right directions of FIG. 18. As a result, the creepage distance between the armature 10 and the movable terminal 20, which is represented by the dotted arrow in FIG. 18, can be ensured.

As shown in FIGS. 16 and 19, the pressing member 12 includes, on the inner surface 88*b*, a first protrusion 94 which engages with an end surface 98 of the insertion 82.

The first protrusion 94 has a shape which protrudes in a straight line extending in the direction parallel to the inner surfaces 88*a*, 88*c* from the vicinity of the aperture 91 to the bottom surface 88*e*. When the pressing member 12 is attached to the armature 10, the first protrusion 94 is arranged parallel to the axis 80.

The first protrusion 94 includes a high part 94*a* and a low part 94*b* which differ in height from the inner surface 88*b*. The high part 94*a* is formed on the side close to the bottom surface 88*e*, and the low part 94*b*, which is shorter in height from the inner surface 88*b* than the high part 94*a*, is formed on the side close to the aperture 91.

Figure 20:
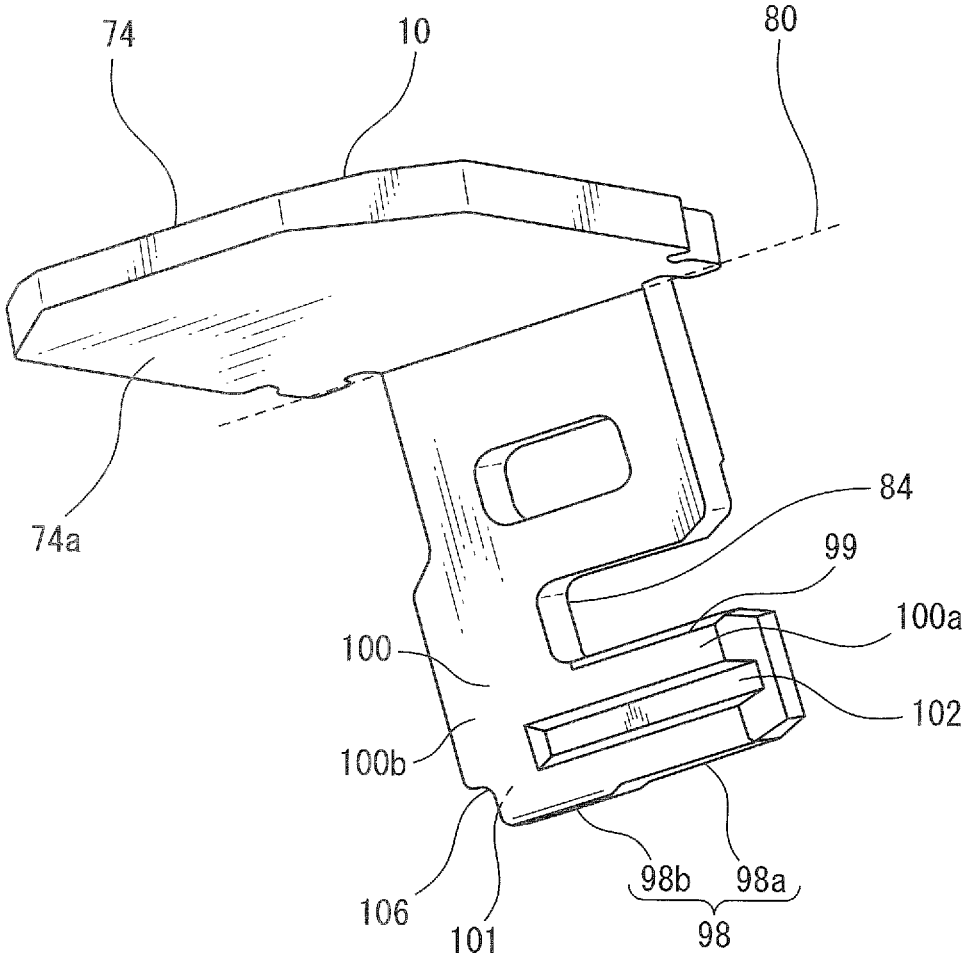
FIG. 20 is a perspective view of the armature.

FIG. 20 is a perspective view of the armature 10. The armature 10 has an end surface 98 on the end of the insertion 82, which is parallel to the axis 80. The end surface 98 has a step-shaped end surface 98*a* near the axis which engages with the high part 94*a*, and the end surface 98*b* distant from the axis 80 which engages with the low part 94*b*.

When the insertion 82 is inserted into the receiving part 88 in direction C to attach the pressing member 12 to the armature 10, the end surface 98 slides on the first protrusion 94. As the insertion 82 is pushed into the receiving part 88, the end surface 98*a* engages so as to be wedged into the high part 94*a* after passing through the low back part 94*b*, and the end surface 98*b* engages so as to be wedged into the low part 94*b*.

The first protrusion 94 positions the pressing member 12 relative to the longitudinal direction of the armature 10. By engaging the end surface 98 with the first protrusion 94, the other edge 99 of the insertion 82 is pressed against the inner surface 88*d*. As a result, the insertion 82 is inserted into and press-fit in the receiving part 88, whereby misalignment of the armature 10 and the pressing member 12 in the vertical direction is prevented.

Furthermore, the end surfaces 98*a*, 98*b* engage with the high part 94*a* and the low part 94*b* at two points. Therefore, inclination of the insertion 82 relative to the pressing member 12 toward the direction in which the degree of parallel alignment between the end surface 98 and the inner surface 88*b* is deteriorated can be prevented. As a result, a high level of parallel alignment between the tip 86*a* and the axis 80 can be secured.

The pressing member 12 comprises a second protrusion 96 which engages with a surface 100 of the insertion 82.

The second protrusion 96 has a shape which extends from the vicinity of the aperture 91 to the bottom surface 88*e* in a straight line extending in the direction parallel to the inner surfaces 88*b*, 88*d*. When the pressing member 12 is attached to the armature 10, the second protrusion 96 is arranged parallel to the axis 80.

The second protrusion 96 has a high part 96*a* and a low part 96*b* which differ in height from the inner surface 88*c*. The high part 96*a* is formed on the side close to the bottom surface 88*e*, and the low part 96*b*, which is shorter than the high part 94*a*, is formed on the side close to the aperture 91.

The armature 10 has a surface 100 and an end surface 106. The surface 100 has a back-side 100*a* distant from the end surface 106, and a front side 100*b* close to the end surface 106. The back-side 100*a* has a recess 102 which is parallel to the axis 80, and a stepped shape is formed on the surface 100 by the recess 102. The surface 100 engages with the high part 96*a* in the recess 102, and engages with the low part 96*b* on the front side 100*b*.

When the insertion 82 is inserted into the receiving part 88 in direction C to attach the pressing member 12 to the armature 10, the surface 100 slides on the protrusion 96. As the insertion 82 is pressed into the receiving part 88, the recess 102 passes the low part 96*b* and then engages with the high part 96*a*, and the front side 100*b* engages with the low part 96*b*.

The second protrusion 96 positions the pressing member 12 relative to the direction in which the second portion 76 moves. By engaging the surface 100 with the second protrusion 96, the surface 100 is pressed against the inner surface 88*a*. As a result, the insertion 82 is inserted into and press-fit in the receiving part 88, whereby misalignment of the armature 10 and the pressing member 12 in direction A is prevented.

Since the surface 100 of the insertion 82 engages with the high part 96*a* and the low part 96*b* at two points, the recess 102 and the front side 100*b*, inclination of the insertion 82 relative to the pressing member 12 toward the direction in which the degree of parallel alignment between the surface 100 and the inner surface 88*c* is deteriorated can be prevented. As a result, a high level of parallel alignment between the tip 86*a* and the axis 80 can be secured.

The end surface 98 and the surface 100 may not have a stepped shape. The first protrusion 94 may be shaped so as to have a constant height without forming the high part 94*a* and the low part 94*b*. Likewise, the second protrusion 96 may be formed so as to have a constant height without forming the high part 96*a* and the low part 96*b*.

In this case, by engaging the end surface 98 with the first protrusion 94, the other edge 99 is pressed against the inner surface 88*d*. As a result, the insertion 82 can be inserted into and press-fit in the receiving part 88, and misalignment between the armature 10 and the pressing member 12 in the vertical directions is prevented.

Furthermore, by engaging the surface 100 with the second protrusion 96, the surface 101 is pressed against the inner surface 88*a*. As a result, the insertion 82 can be inserted into and press-fit in the receiving part 88, and misalignment between the armature 10 and the pressing member 12 in direction A is prevented.

Figure 21A:
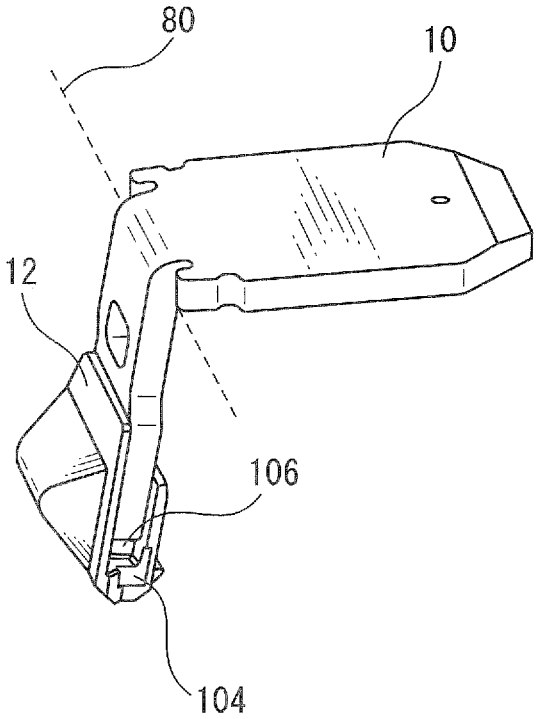
FIG. 21A is a view detailing the crimped parts of the pressing member.

FIGS. 21A and 22B are views showing the crimp structure which secures the pressing member in the armature. The pressing member 12 includes a crimped part 104 which is adjacent to the aperture 91 and which is positioned toward the right of the receiving part 88. The armature 10 has an end surface 106 formed by cutting one end thereof.

The crimped part 104 is deformed by applying heat. FIG. 21A shows the crimped part 104 prior to deformation, and FIG. 21B shows the crimped part 104 after deformation.

Figure 21B:
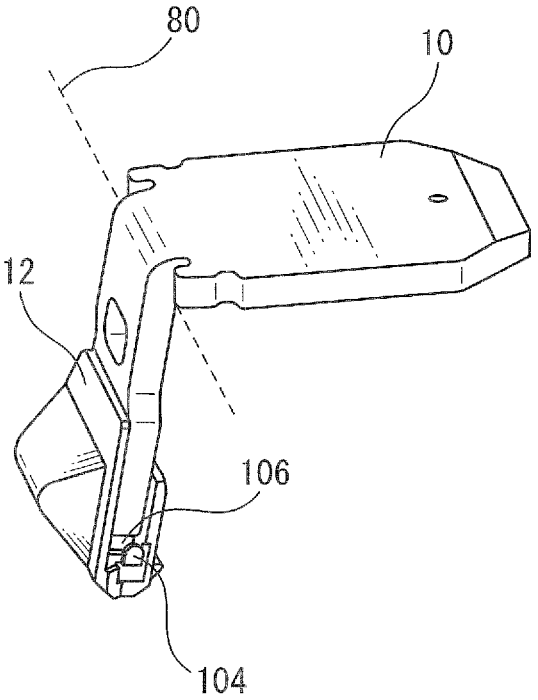
FIG. 21B is a view detailing the crimped parts of the pressing member.

The deformed crimped part 104 shown in FIG. 21B engages with the end surface 106. By engaging the crimped part 104 with the end surface 106, the pressing member is secured in the armature, and misalignment of the pressing member 12 can be prevented, even when an external shock is received.

Figure 9:
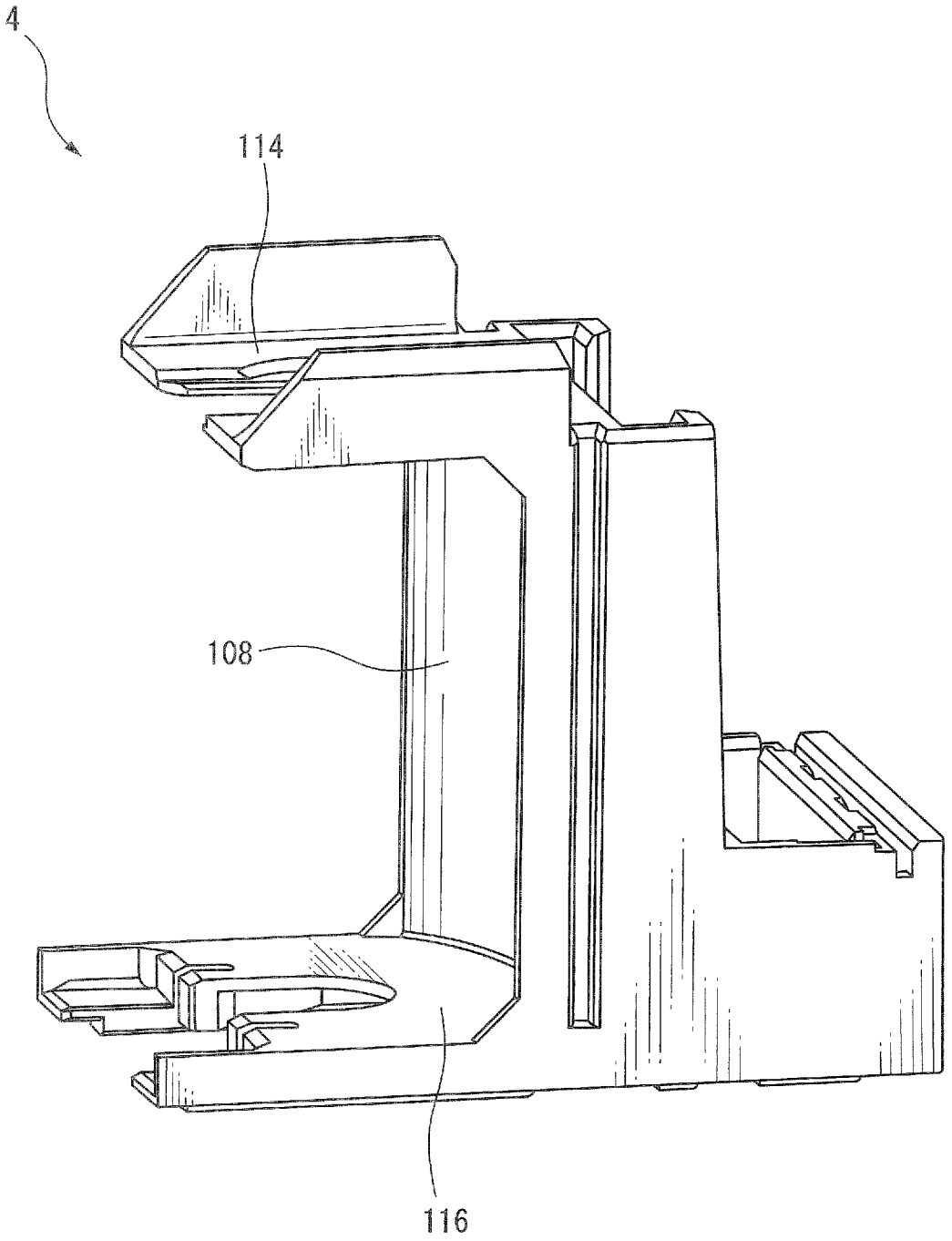
FIG. 9 is a perspective view of a base.

The insulation structure of the relay 2 will be described with reference to FIGS. 9 and 11. FIG. 9 is a perspective view of the base 4. In the relay 2, insulation distances are maintained for each of the parts while the size of the device is reduced. Note that the insulation distances include gap distance and creepage distance.

The relay 2 comprises a first area 110 in which the coil 34 and the iron core 30 are arranged, and a second area 112 in which the movable terminal 20, the fixed terminal 26, and the pressing member 12 are arranged. The base 4 includes a wall 108 which is positioned between the first area 110 and the second area 112 and which extends in the upwards and downwards directions.

The wall 108 is formed from, for example, a resin, and insulates the coil 34 from the movable terminal 20 and the fixed terminal 26. Since the wall 108 is formed so as to separate the first area 110 and the second area 112 and so as to cover the portion of the coil 34 in the vicinity of the second area 112, the insulation distance between the coil 34 and the movable terminal 20 and the fixed terminal 26 can be maintained.

The first portion 74 is arranged in the first area 110 above the coil 34 and the iron core 30. The second portion 76 is arranged in the second area 112 extending from the first portion 74.

Since the pressing member 12 is attached to the second portion 76, the insulation distance between the armature 10 and the movable terminal 20 can be maintained by the pressing member 12.

The bobbin 36 has a first flange 118, a second flange 120, and a cavity 121 into which the iron core 30 is inserted. The bobbin 36 is formed from, for example, a resin. The first flange 118 and the second flange 120 insulate the iron core 30 and the coil 34. Since the first flange 118 and the second flange 120 cover the upper surface 34*a* and the lower surface 34*b* of the coil 34, the insulation distance between the iron core 30 and the coil 34 can be maintained.

The base 4 includes a first extending part 114 and a second extending part 116 arranged in the first area 110 which extend from the wall 108. The first extending part 114 is connected to the wall 108, and protrudes toward the first area 110. The second extending part 116 is connected to the wall 108, and protrudes toward the first area 110. The first extending part 114 is opposed to an upper portion of the first flange 118. The second extending part 116 is opposed to a lower portion of the second flange 120. The first extending part 114 and the second extending part 116 insulate the coil 34, the armature 10, and the yoke 32. Since the upper surface 34*a* is covered by the first extending part 114 and the first flange 118, the insulation distance between the coil 34 and the first portion 74 can be maintained. Likewise, since the lower surface 34*b* is covered by the second extending part 116 and the second flange 120, the insulation distance between the coil 34 and the first portion 122 can be maintained.

The yoke 32 comprises a first portion 122 arranged in the first area 110, and a second portion 124 arranged in the second area 112 which extends so as to bend away from the first portion 122. The second portion 124 is present along the wall 108, and supports the bend part 78 along the end 126. The wall 108 insulates the second portion 124 and the coil 34. Since the wall 108 covers the coil 34, the insulation distance between the coil 34 and the second portion 124 can be maintained.

By using the bobbin 36 and the base 4 of the present embodiment, the insulation distance between the coil 34 and the other parts can be maintained. Since it is not necessary to provide additional elements for maintaining insulation, an increase of the space within the relay can be prevented, and the insulation properties between the components can be maintained while maintaining the small size of the relay.

The yoke 32 includes an aperture 128 in the first portion 122. The iron core 30 includes a protrusion 130 on an end thereof. By inserting and crimping the protrusion 130 in the aperture 128, the iron core 30 and the yoke 32 are connected to form a magnetic path.

The iron core 30 comprises a shaft 132 which is inserted into the cavity 121, and a head 124 which is arranged outside of the first flange 118. A head 134 includes a surface 134*a* which extends outwardly from the tip of the shaft 132 on the outside of the coil 34 and which faces outside in the axial direction of the iron core 30. The attractable surface 74*a* is attracted to the surface 134*a* by the excitation of the coil 34.

The head 134 includes a surface 134*b* which projects outwardly from the outer circumference of the shaft 132 on the side opposite the surface 134*a*. The first extending part 114 extending from the wall 108, has a thin portion 114*a* at the tip thereof which is inserted between the head 134 and the coil 34, and more specifically, between the surface 134*b* of the head 134 and the first flange 118.

Figure 24:
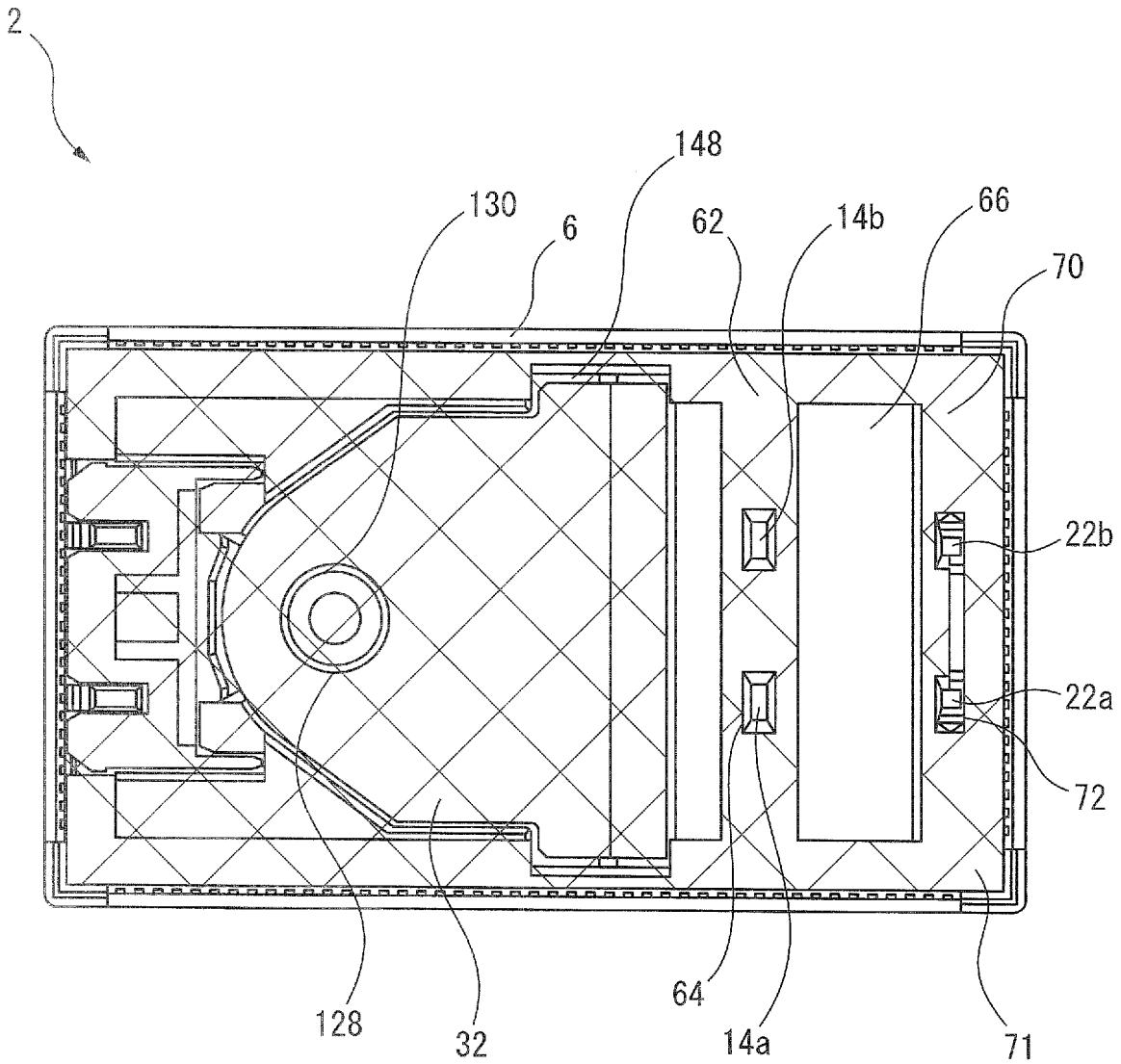
FIG. 24 is a bottom view of the relay.

The assembly of the relay 2 will be described with reference to FIGS. 2, 11, and 24. FIG. 24 is a bottom view of the relay 2. After housing the bobbin 36 on which the coil 34 is wound into the base 4, the iron core 30 is inserted from above, the head 134 is inserted between the first extending part 114 and the second extending part 116 with a posture adjacent to the first extending part 114.

An aperture 148 through which the second extending part 116 is exposed is provided in the bottom 61 of the base 4. The second portion 124 is inserted from the aperture 148, and the first portion 122 is arranged outside the second extending part 116. Thereafter, the protrusion 130 protruding from the bobbin 36, is inserted into and crimped in the aperture 128.

As a result, the thin portion 114*a* is interposed between the surface 134*b* and the first flange 118, and the second extending part 116 is interposed between the first portion 122 and the second flange 120. Thus, the electromagnet 7 and the base 4 are firmly secured without looseness.

As shown in FIG. 24, the first portion 122 is exposed from the aperture 148. The adhesive 71, which is represented by the hatched lines, is applied to the bottom 61. In the present embodiment, the adhesive 71 covers the first portion 122 and the bottom 61 around the first portion 122.

By inserting the yoke 32 from the aperture 148, assembly of the relay 2 is simplified, and by covering the bottom 61 with adhesive 71, the relay 2 is sealed so that the intrusion of foreign matter into the interior of the relay 2 can be prevented. Further, the insulation between the relay 2 and external devices is maintained.

Figure 22:
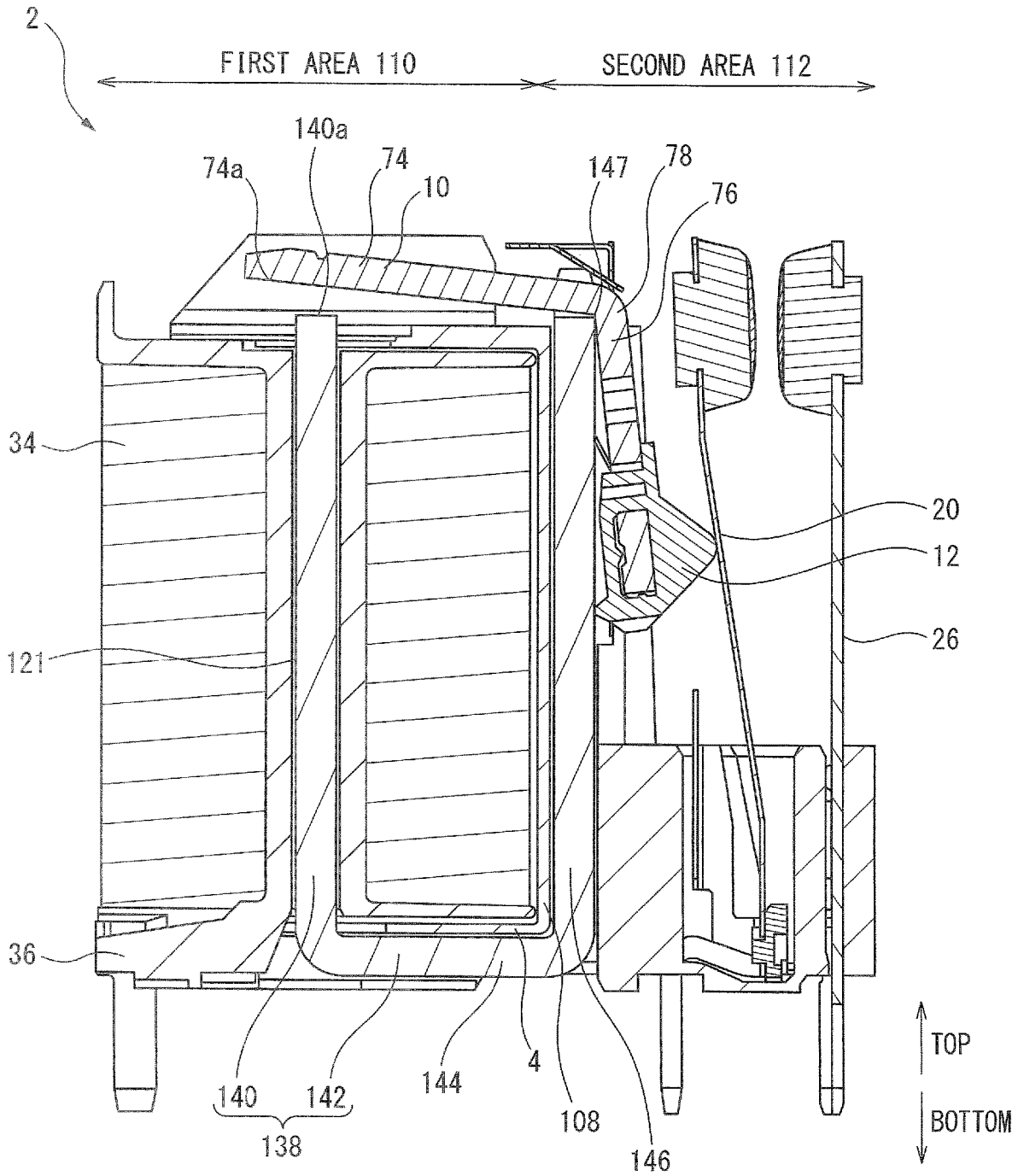
FIG. 22 is a cross-sectional view of a modified example of the relay.

FIG. 22 is a cross-sectional view of a modified example of the relay 2 taken along line A1-A1 of FIG. 1. In the present embodiment, the iron core 30 and the yoke 32 are integrally formed in the metal part 138, whereby the production cost of the relay 2 can be reduced.

The metal part 138 comprises an iron core 140 which is inserted into the cavity 121, and a yoke 142 which extends so as to bend away from the iron core 140. The iron core 140 has a surface 140*a* outside and above the coil 34. The surface 140*a* attracts the contact surface 74*a* by the excitation of the coil 34.

The yoke 142 comprises a first portion 144 arranged in the first ara 110 which extends so as to bend away from the iron core 140, and a second portion 146 arranged in the second area 112 which extends away from the first portion 144. The second portion 146 extends along the wall 108, and supports the bent part 78 on the end 147. The wall 108 insulates the second portion 146 and the coil 34.

Figure 23:
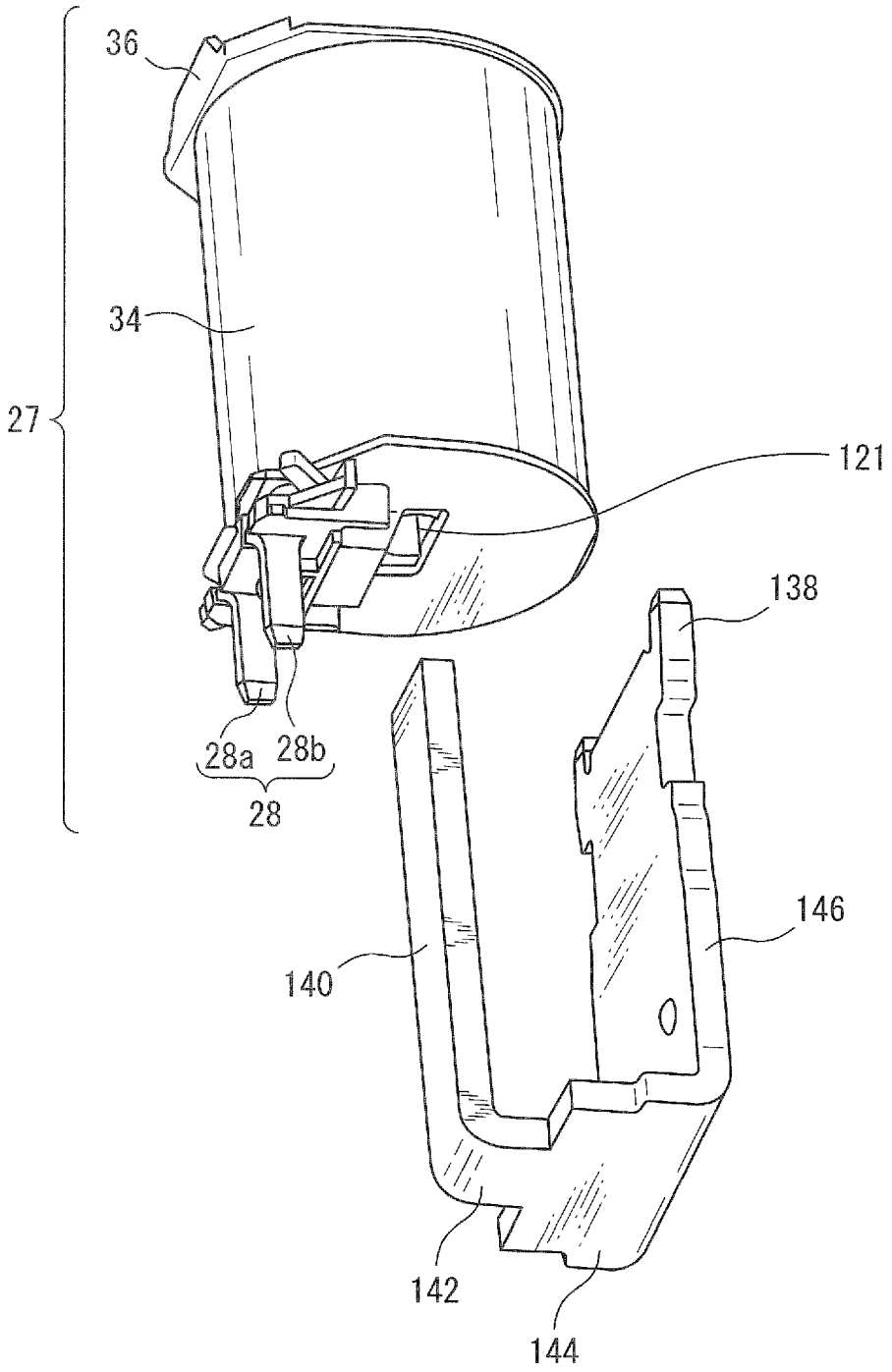
FIG. 23 is a perspective view of the coil assembly and a metal part of the modified example.

FIG. 23 is a perspective view of the coil assembly 27 and the metal part 138 according to a modified example. As shown in FIG. 23, the iron core 140 and the cavity 121 are formed so as to be, for example, rectangular parallelepipeds.

The embodiments described above can be appropriately combined. Furthermore, in the drawings described above, identical or corresponding portions are assigned the same reference signs. Note that the embodiments described above are merely exemplary and do not limit the invention.

The invention claimed is:

1. A relay, comprising:

an electromagnet;

an armature which pivots about a pivot axis by excitation of the electromagnet and extends from the pivot axis;

a pressing member attached to a tip of the armature; and a terminal which is pressed by the pressing member, wherein the armature comprises a first part which is attracted to the electromagnet, a second part extending from the first part, a plate-like first insertion part which is provided at an end of the second part and extends in a first direction parallel to the pivot axis, and a guide groove provided between the second part and the first insertion part and which extends in the first direction, and the pressing member comprises an enclosure extending in the first direction and which is open on one end, a receiving part formed therein, and a second insertion part, wherein the first insertion part is configured to be inserted into the receiving part from the first direction, and wherein the second insertion part is configured to be inserted into the guide groove.

2. The relay according to claim 1, wherein the enclosure covers the first insertion part.

3. The relay according to claim 1, wherein the pressing member further comprises a protrusion on an inner surface of the enclosure which engages with an end surface of the first insertion part.

4. The relay according to claim 3, wherein the protrusion is in the form of an elongated projection which extends parallel to the pivot axis.

5. The relay according to claim 1, wherein the pressing member further comprises a protrusion on an inner surface of the enclosure which engages with the guide groove.

6. The relay according to claim 1, wherein the enclosure comprises an opening, wherein the pressing member is arranged adjacent to the opening, and comprises crimped parts which are engaged with an end surface of the insertion part by crimping.

7. The relay according to claim 1, wherein the enclosure comprises a plurality of walls, and one of the walls serves as the second insertion part.

8. A relay, comprising:

an electromagnet;

an armature which pivots about a pivot axis by excitation of the electromagnet;

a pressing member attached to a tip of the armature; and a terminal which is pressed by the pressing member, wherein:

the armature comprises a plate-like insertion part which extends in a direction parallel to the pivot axis, and a guide groove provided in the insertion part and which extends in a direction parallel to the pivot axis, the pressing member comprises an enclosure which is open on one end, and a part of the enclosure is inserted into the guide groove, the pressing member comprises a protrusion on an inner surface of the enclosure which engages with an end surface of the insertion part, and the protrusion is in the form of an elongated projection which extends parallel to the pivot axis.

* * * * *